340-566 SR
3/25/86 XR 4,578,665

United States Patent [19]

Yang

[11] Patent Number: 4,578,665

[45] Date of Patent: Mar. 25, 1986

[54] REMOTE CONTROLLED SURVEILLANCE TRAIN CAR

[76] Inventor: Tai-Her Yang, Post Office Box 84-85, Taipei, Taiwan

[21] Appl. No.: 615,576

[22] Filed: May 31, 1984

Related U.S. Application Data

[63] Continuation-in-part of Ser. No. 372,830, Apr. 28, 1982, abandoned.

[51] Int. Cl.[4] ..... B61L 15/00

[52] U.S. Cl. ..... 340/48; 340/47; 340/539; 340/566; 246/121; 246/167 D; 358/108; 364/426; 381/56; 73/636

[58] Field of Search ..... 340/47–49, 340/506, 500, 507, 539, 601, 602, 632, 566, 583; 364/424, 426, 447, 456, 550; 246/167 D, 167 R, 111, 117, 120, 121, 187 A, 187 B, 187 C, 182 B; 381/56, 57; 358/103, 104, 108; 455/9, 12, 53, 54, 67; 367/197–199; 73/636

[56] References Cited

U.S. PATENT DOCUMENTS

| | | | |
|---|---|---|---|
| 2,762,913 | 9/1956 | Jepson . | |
| 3,128,975 | 4/1964 | Dan | 246/121 |
| 3,258,595 | 6/1966 | Galante | 358/108 |
| 3,272,982 | 9/1966 | Stewart . | |
| 3,365,572 | 1/1968 | Strauss | 246/167 |
| 3,426,146 | 2/1969 | Seaman | 358/108 |
| 3,790,780 | 2/1974 | Helmcke et al. | 246/187 C |
| 3,819,932 | 6/1974 | Auer, Jr. et al. | 246/187 B |
| 3,934,252 | 1/1976 | Ross et al. . | |
| 4,112,818 | 9/1978 | Garehime, Jr. | 358/108 |
| 4,345,274 | 8/1982 | Bambara | 358/108 |
| 4,500,970 | 2/1985 | Daemmer | 364/424 |

FOREIGN PATENT DOCUMENTS

| | | | |
|---|---|---|---|
| 1234256 | 2/1967 | Fed. Rep. of Germany . | |
| 0126605 | 11/1978 | Japan | 246/121 |
| 119109 | 3/1926 | Switzerland . | |

OTHER PUBLICATIONS

"The Surveyor Lunar Landing Television System", Montgomery & Wolf, IEEE Spectrum, pp. 54–61 (Aug. 1966).

*Primary Examiner*—Donnie L. Crosland
*Attorney, Agent, or Firm*—Cushman, Darby & Cushman

[57] ABSTRACT

A self-propelled remotely controlled satellite car precedes a train along train tracks. The satellite car is remotely controlled to travel a predetermined distance ahead of the train. The satellite car is equipped with a sensor array which measures a variety of different parameters such as sound level, temperature, the presence of noxious gases, moisture, orientation with respect to the direction of the force of gravity and vibration level. The satellite car may be equipped with a television camera. Information gathered by the satellite car is transmitted back to the train to enable the train engineer to be apprised of conditions existing on the tracks ahead of the train in order to have time to react to potential hazards. Position indicators disposed along the tracks transmit position information to the satellite car to permit the satellite car to correlate measured information with expected information. The satellite car and the train may be linked by infrared, electromagnetic, or ultrasonic transmitters and receivers. Actuators operatively connected to a chair on board the train may vibrate the chair in accordance with vibration levels detected on the satellite car to alert a human seated in the chair of vibration levels soon to be encountered by the train.

14 Claims, 24 Drawing Figures

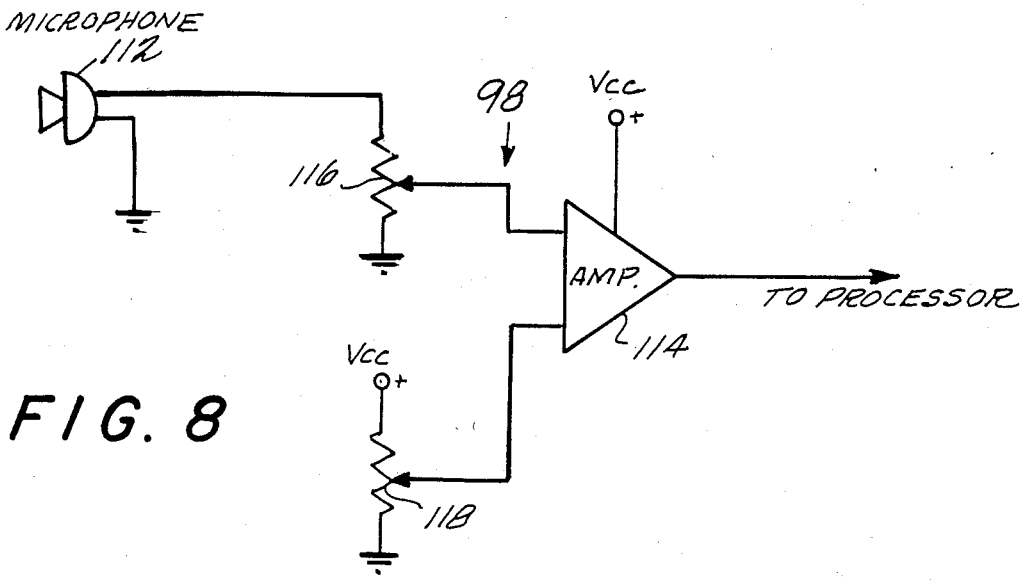
FIG. 8
FIG. 19
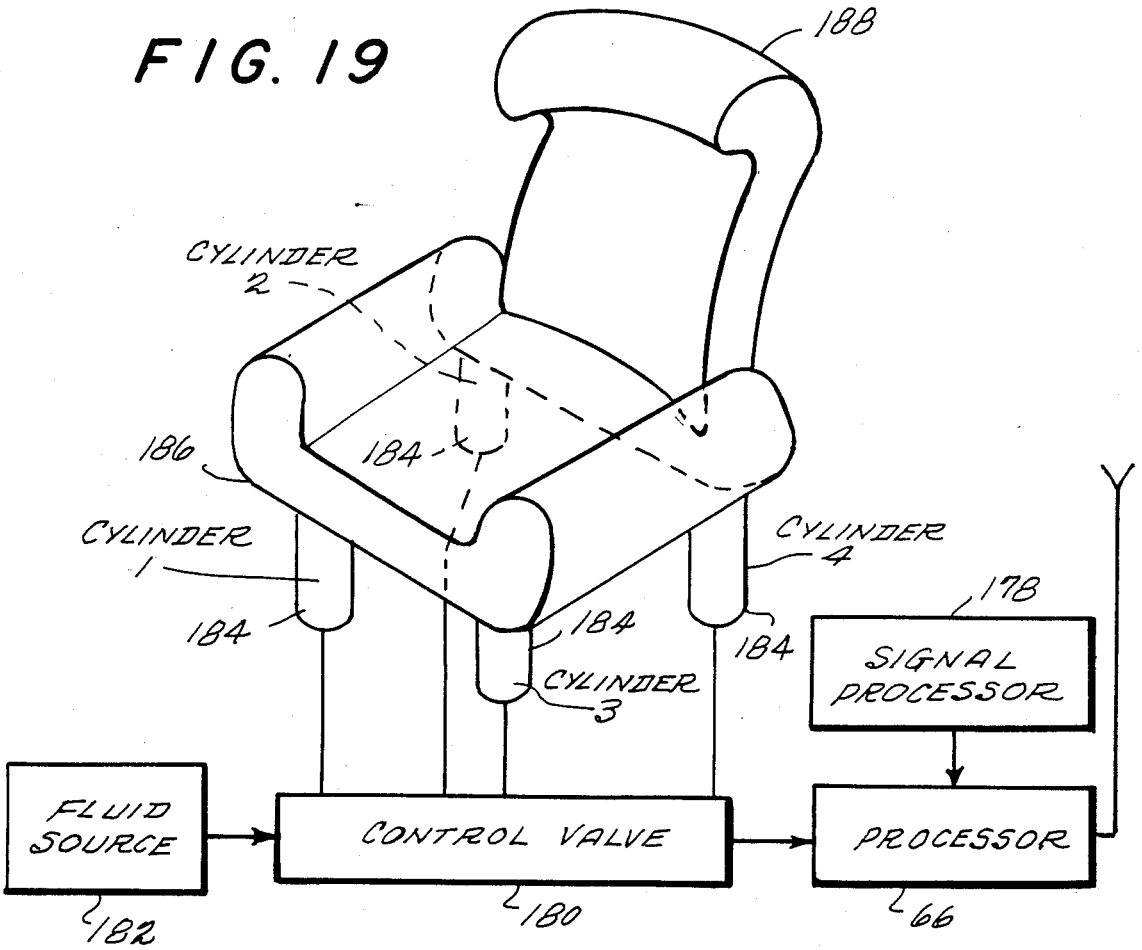

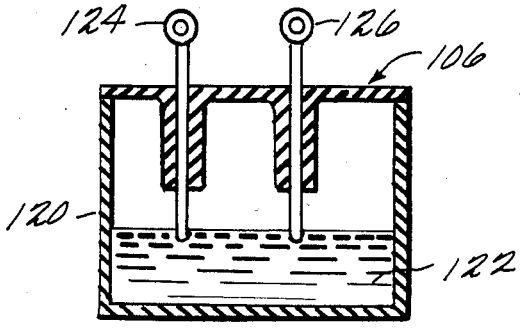
FIG. 9
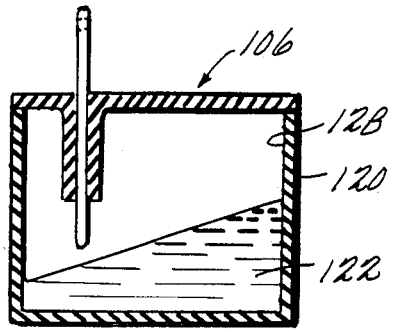
FIG. 11-1
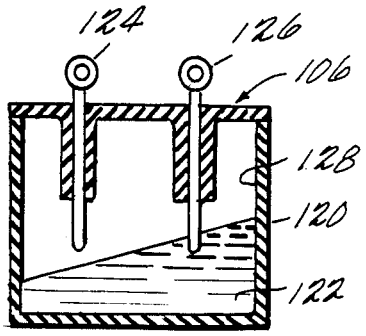
FIG. 10
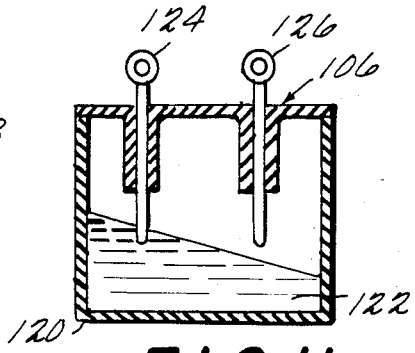
FIG. 11
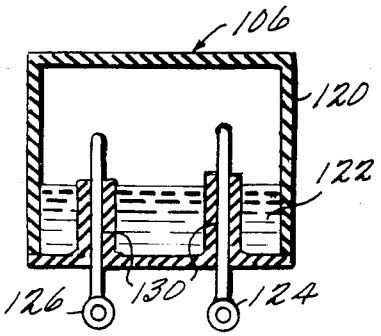
FIG. 12
FIG. 18
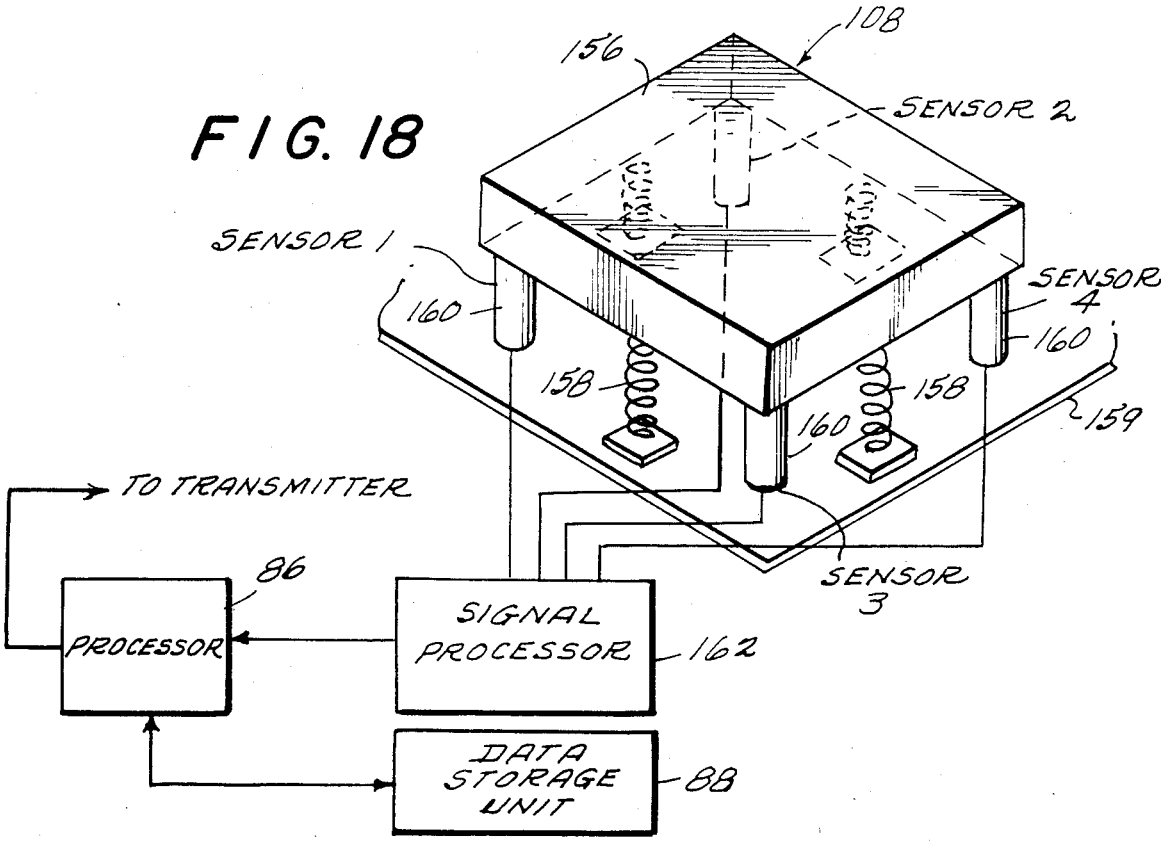

MULTI-DETECTOR
OSC.
NOISE REDUCER
AM DETECTOR
NOISE BLANKER SWITCH
NOISE BLANKER
A.C. SWITCH
AMP.
SIGNAL CONTROL CIRCUIT
CONTROL & DRIVING CIRCUIT
DRIVER
CUT-OFF AGC DETECTOR
UP AGC DETECTOR
U
L
A
AGC
MID-BAND AMP.
FILTER
VERNIER TUNER
DETECTOR
FROM OSC. FREQUENCY SYNTHESIZER
ANT.
SQUELCH POT.

REMOTE CONTROLLED SURVEILLANCE TRAIN CAR

CROSS REFERENCES TO RELATED APPLICATIONS

This application is a continuation-in-part of application Ser. No. 372,830 filed on April 28, 1982, now abandoned.

FIELD OF THE INVENTION

The present invention is related to systems for surveying conditions existing on train tracks. More particularly, the present invention is related to a surveillance system on board a satellite car travelling ahead of a train which senses conditions existing on the tracks and establishes control and communications between the satellite car and the train.

BACKGROUND OF THE INVENTION

As technology has developed, mankind has vastly increased his mobility. At one time, a horse-drawn chariot was the fastest mode of surface transportation available. Today, one can travel across the surface of the earth by train at speeds in excess of 100 kilometers. As Nathaniel Hawthorne once said, "[r]ailroads . . . are positively the greatest blessing that the ages have wrought out for us. They give us wings; they annihilate the toil and dust of pilgrimage; they spiritualize travel!" *The House of the Seven Gables.*

Unfortunately, as the speed of trains has increased, the potential danger of operating and riding trains has also increased. The time which the operator of the train has to react to a potentially dangerous situation (such as an obstruction in the path of the train) decreases proportionally with the speed of the train. For this reason, the risk of serious accident and the occurrence of accidents increases as the speed of the vehicle increases. Likewise, nearly any accident involving a train travelling at a very high speed is likely to be a serious accident.

Many potentially dangerous situations arise on a railway. For instance, railroad tracks can be damaged by floods, landslides or sabotage. Stopped railway vehicles can obstruct the track ahead of a rapidly moving train. If the train is moving at a great speed, the train engineer often does not have sufficient time to react to a dangerous situation in order to safely stop the train in time.

Solutions to this problem have been proposed in the past. U.S. Pat. No. 3,272,982 to Stewart (issued Sept. 13, 1966) discloses a surveying system in which a satellite train car precedes a main rail car. The satellite car transmits an infrared beam to a receiver on the main rail car for the purpose of surveying the track. The satellite rail car is self-propelled, its velocity being remotely controlled via an infrared beam transmitted by the main rail car. Other references disclosing the use of satellite railway cars are U.S. Pat. No. 3,128,975 to Dan (issued April 14, 1964), Swiss Pat. No. 119,109 (issued Mar. 6, 1926) and German Pat. No. 1,234,256 (issued Feb. 16, 1967).

U.S. Pat. No. 3,258,595 to Galante (issued June 28, 1966) discloses a satellite observation body which propels itself over the surface of the water and communicates via a laser beam with a remote control station on board a submarine. The movements of the satellite body may be controlled from the remote control station. A television camera on board the satellite body surveys the surface of the water and communicates information back to the remote control station.

Several schemes have been developed for preventing collision between two train cars travelling along the same rail or for maintaining the distance between such train cars constant. See, for example, U.S. Pat. No. 3,790,780 to Helmcke et al (issued Feb. 5, 1974), U.S. Pat. No. 3,365,572 to Strauss (issued Jan. 23, 1968), U.S. Pat. No. 2,762,913 to Jepson (issued Sept. 11, 1956), and U.S. Pat. No. 3,819,932 to Auer, Jr. et al (issued June 25, 1974). Each of these schemes require cooperative transmitters and receivers mounted on each train car travelling along the railway. U.S. Pat. No. 3,934,252 to Ross et al (issued Jan. 20, 1976) discloses a radio transmitter/-receiver for reliably and automatically detecting a potential collision of a protected vehicle with an arbitrary object.

U.S. Pat. No. 4,112,818 to Garehime, Jr. (issued Sept. 12, 1978) and U.S. Pat. No. 3,426,146 to Seaman (issued Feb. 4, 1969) both disclose automatic surveillance systems utilizing video cameras. See also Montgomery and Wolf, "The Surveyor Lunar Landing Television System", *IEEE Spectrum,* page 54–61 (August 1966).

SUMMARY OF THE INVENTION

The present invention is a system utilizing a remote controlled satellite surveillance train car for reducing the frequency of railway accidents. A satellite car and train to be protected travel rectilinearly along the same railway tracks. The satellite car includes a propulsion device for propelling it along the tracks. The propulsion device is controlled by a controller which maintains the satellite car a predetermined distance ahead of the train. The controller may in turn be remotely controlled by signals transmitted by a transmitter on board the train. At least one surveying device on board the satellite car acquires information about the conditions existing on the tracks in proximity with the satellite car and transmits this information back to the train. The train receives and displays the transmitted information.

The surveying device may include an audio detector for detecting the level of sound produced as the satellite car travels along the rails and for comparing the detected level of sound with a predetermined value or with a stored level obtained from prior measurements made for the same section of the railway tracks. The surveying device may include a temperature detector for detecting the temperature in proximity with the satellite car and for determining if the detected temperature is within a predetermined range. The surveying device may include a noxious gas detector for detecting the presence of at least one of a plurality of gases in proximity with the satellite car. The surveying device may include a moisture detector disposed on the satellite car a predetermined distance above the rails for detecting the presence of water. The surveying device may also include an orientation monitor for monitoring the orientation of the satellite car with respect to the direction of the force of gravity of the earth. The surveying device may include a television camera for monitoring the visual scene presented to the satellite car as it travels along the rails. The surveying device may include a vibration detector for detecting the level of mechanical vibration present on the satellite cars as it travels along the rails. The train may include a chair adapted to accept a seated human being and including devices responsive to the detected mechanical vibration level present on the satellite car for vibrating the chair according to the detected vibration level.

BRIEF DESCRIPTION OF THE DRAWINGS

These and other features of the present invention will be more completely appreciated by reading the following detailed description taken in conjunction with the accompanying drawings, of which:

FIG. 8 is schematic diagram of an audio detector in accordance with the present invention;

FIG. 9 is a side view in section of a level detecting apparatus in accordance with the present invention oriented level with respect to the direction of the force of gravity of the earth;

FIG. 10 is a side view in section of the level detector shown in FIG. 9 oriented in a first tipped position with respect to the direction of the force of gravity;

FIG. 11 is a side view in section of the level detector shown in FIG. 9 oriented in a second tipped position with respect to the direction of the force of gravity;

FIG. 11-1 is a side view in section of another embodiment of a level detector in accordance with the present invention oriented in a tipped position with respect to the direction of the force of gravity;

FIG. 12 is a side view in section of the level detector shown in FIG. 9 inverted with respect to the position shown in FIG. 9;

FIG. 18 is a perspective elevated view of a vibration sensor in accordance with the present invention; and FIG. 19 is a side perspective view and functional block diagram of a imitative vibrational chair in accordance with the present invention.

DETAILED DESCRIPTION OF PREFERRED EMBODIMENTS

Figure 1:
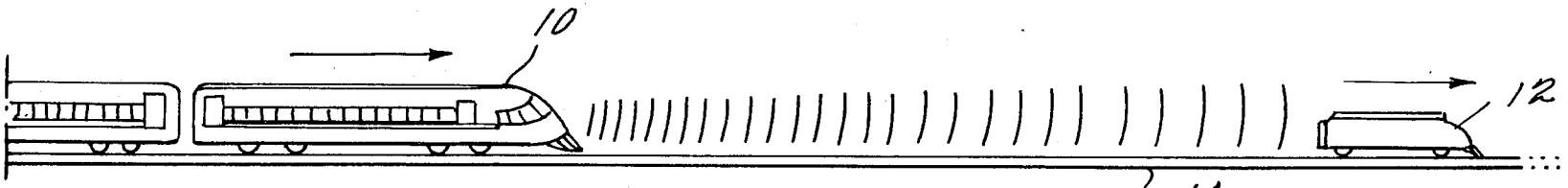
FIG. 1 (PRIOR ART)
FIG. 1 is a side elevational view of a satellite car travelling ahead of a train along a set of rails.
Figure 2:
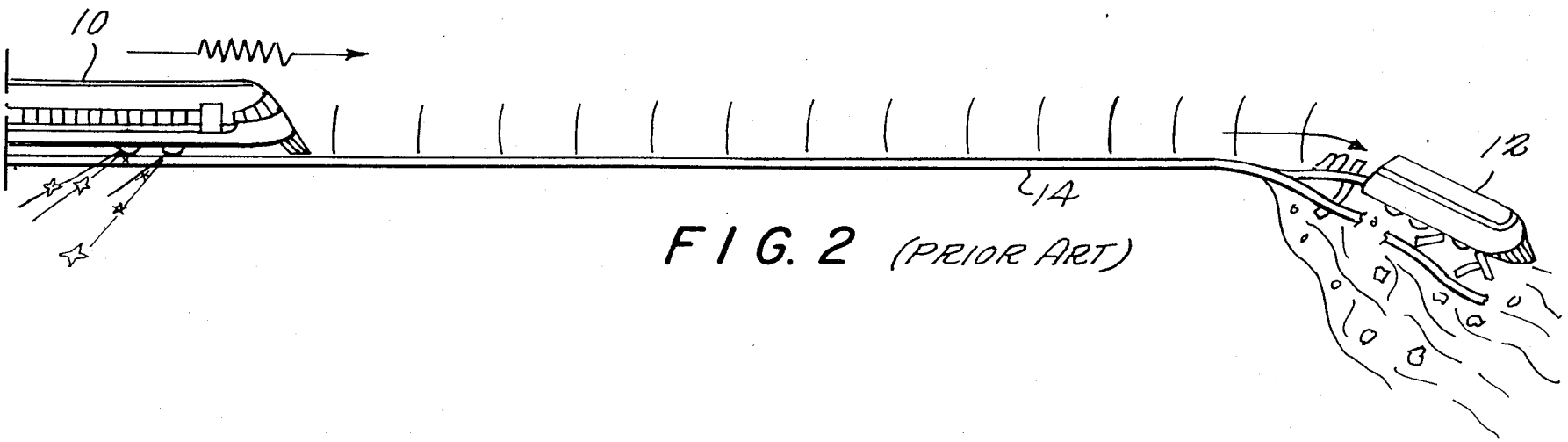
FIG. 2 (PRIOR ART)
FIG. 2 is a side elevational view of the train shown in FIG. 1 showing the train slowing and stopping when the satellite car encounters a dangerous situation on the rails.

FIG. 1 shows a train 10 and a satellite car 12 simultaneously travelling along a set of rails 14. Satellite car 12 is self-propelled and is remotely controlled by transmissions produced by train 10. If satellite car 12 encounters a potential hazard in track 14, it may transmit information about the hazard back to train 10, permitting the engineer driving train 10 to stop the train well before the train encounters the hazard (as is shown in FIG. 2).

In accordance with the present invention, satellite car 12 is remotely controlled by train 10. Mounted on board satellite car 12 is a surveying system (to be discussed in greater detail shortly) for detecting and surveying the rail conditions ahead of it. Satellite car 10 includes an independent self-propulsion system that may be operated manually or may be remotely controlled via a signal transmitted from train 10 and received by satellite car 12. Satellite car 12 is capable of varying its velocity as a function of the signals transmitted from train 10 to the satellite car, thereby permitting the satellite car to travel a constant predetermined distance ahead of the train.

Figures 3A, 3B, 3C:
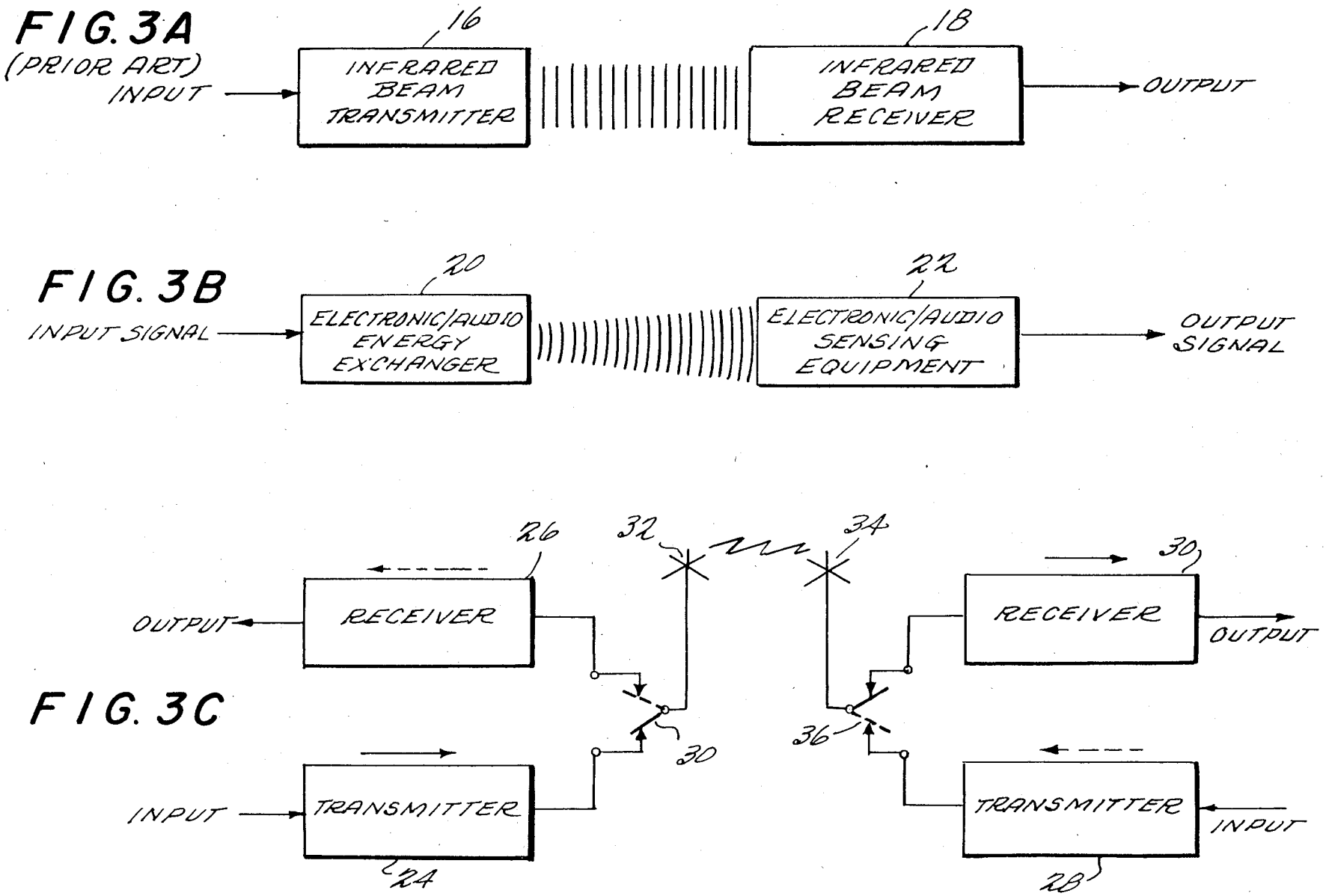
FIG. 3A (PRIOR ART)
FIG. 3*a* is a block diagram of an infrared transmitter and its cooperative receiver.
FIG. 3*b* is a block diagram of an ultrasonic transmitter and receiver in accordance with the present invention.
FIG. 3*c* is a block diagram of a system in accordance with the present invention for duplex transmission and reception using a common antenna for both reception and transmission.

Satellite car 12 senses the condition of the rails in proximity to and ahead of it with a surveillance system mounted on board. The results of this survey are transmitted back to the control room of train 10. FIG. 3*a* shows the use of a conventional infrared beam transmitter 16 and a conventional infrared beam receiver 18 for transmitting information from satellite car 12 to train 10. The infrared beam transmitter and infrared beam receiver may also be used to transmit remote control information from train 10 to satellite car 12 (i.e. there may be two infrared beam transmitters, one on board each of train 10 and satellite car 12, and likewise, there may be two infrared beam receivers 18). FIG. 3*b* shows the use of an ultrasonic transmitter 20 and an ultrasonic receiver 22 (both conventional in design) for communicating information between satellite car 12 and train 10. FIG. 3*c* shows the use of a duplex transmission system for communicating information from satellite car 12 to train 10 and from train 10 to satellite car 12. A transmitter 24 and a receiver 26 are placed on board train 10. A transmitter 28 and a receiver 30 are placed on board satellite car 12. The transmitter 24 and receiver 26 are selectively (alternately) connected via a switch 30 (which may a conventional TR switch) to an antenna 32 mounted on train 10. Likewise, transmitter 28 and receiver 30 may be selectively (alternately) connected to an antenna 34 mounted on satellite car 12 via a switch 36. Transmitter 24 and receiver 30 should be tuned to the same frequency. Transmitter 28 and receiver 26 should also be tuned to the same frequency. In this way, control information produced on board train 10 may be transmitted via transmitter 24 to receiver 30 and thereafter connected to circuitry on board satellite car 12. Likewise, information sensed by satellite car 12 may be transmitted to train 10 via transmitter 28 and receiver 26 and thereafter connected to the monitoring systems on board train 10 to apprise the engineer of rail conditions.

Figure 3D:
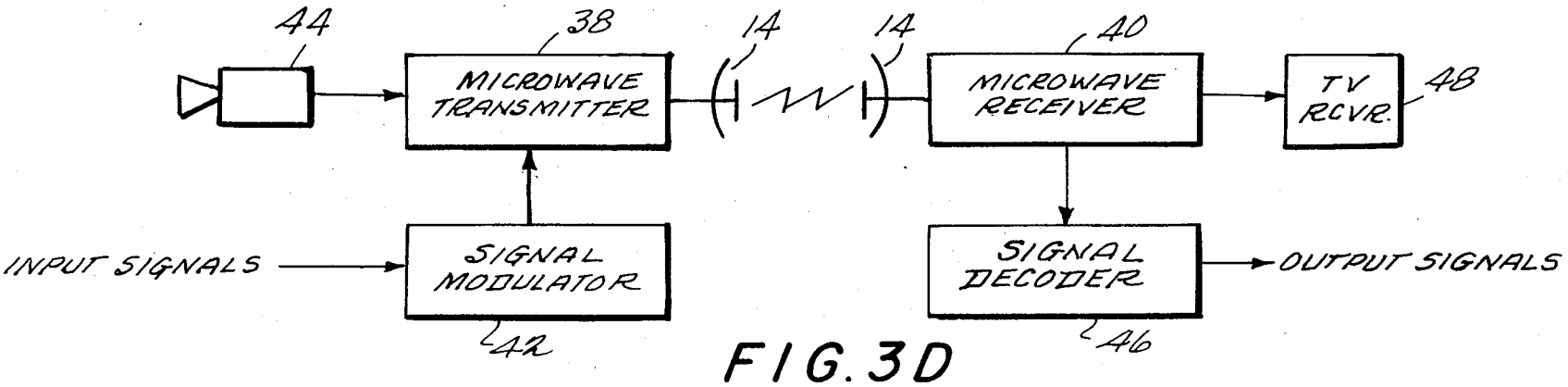
FIG. 3*d* is a block diagram of a microwave transmission system in accordance with the present invention.

FIG. 3*d* shows a block diagram of a microwave transmission and receiving system in accordance with the present invention. A microwave transmitter 38 on board satellite car 12 transmits microwaves to a microwave receiver 40 on board train 10. The microwave may be transmitted either through the air or via a waveguide defined by the structure of rails 14. The microwaves transmitted by transmitter 38 may be modulated by a signal modulator 42 responsive to the signals produced by various sensors on board satellite car 12. Signal modulator 12 may modulate the microwaves produced by transmitter 38 in any known method (such as frequency modulation, amplitude modulation, pulse code modulation, pulse width modulation, etc.). The microwaves produced by transmitter 38 may also be modulated by the video signal produced by a conventional television camera 44. The microwave receiver is connected to a signal decoder 46 which conventionally demodulates the signals impressed upon the microwaves by signal modulator 42. Microwave receiver 40 may also be connected to a image display (such as a conventional television receiver 48) for displaying the video produced by camera 44.

Figure 3E:
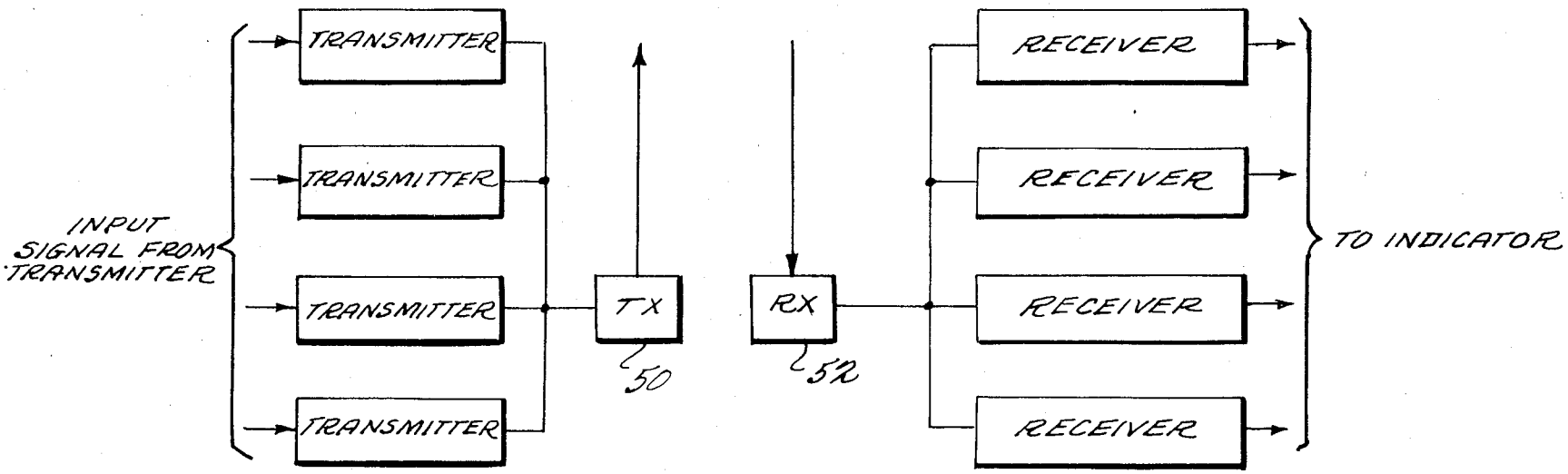
FIG. 3*e* is a block diagram of a multiplexing transmission system in accordance with the present invention.

As is well known, plural signals may be multiplexed onto the same transmitted carrier signal. FIG. 3*e* shows several different signals connected to the same transmitter 50. Transmitter 50 may produce microwaves, infrared radiation or ultrasonic radiation, as discussed previously. A receiver 52 receives the transmitted signal and demultiplexes the various signals impressed upon it. Each of the demultiplexed signals may be routed to a respective indicator (not shown).

Those skilled in the art can readily devise other methods for transmitting information between satellite car 12 and train 10. For instance, conventional electrical signals conducted by the rails or by overhanging cables could be used to convey information. Acoustic signals transmitted over the rails might be used to transmit intelligence between train 10 and satellite car 12. The present invention is by no means limited to any one such method.

Figure 4:
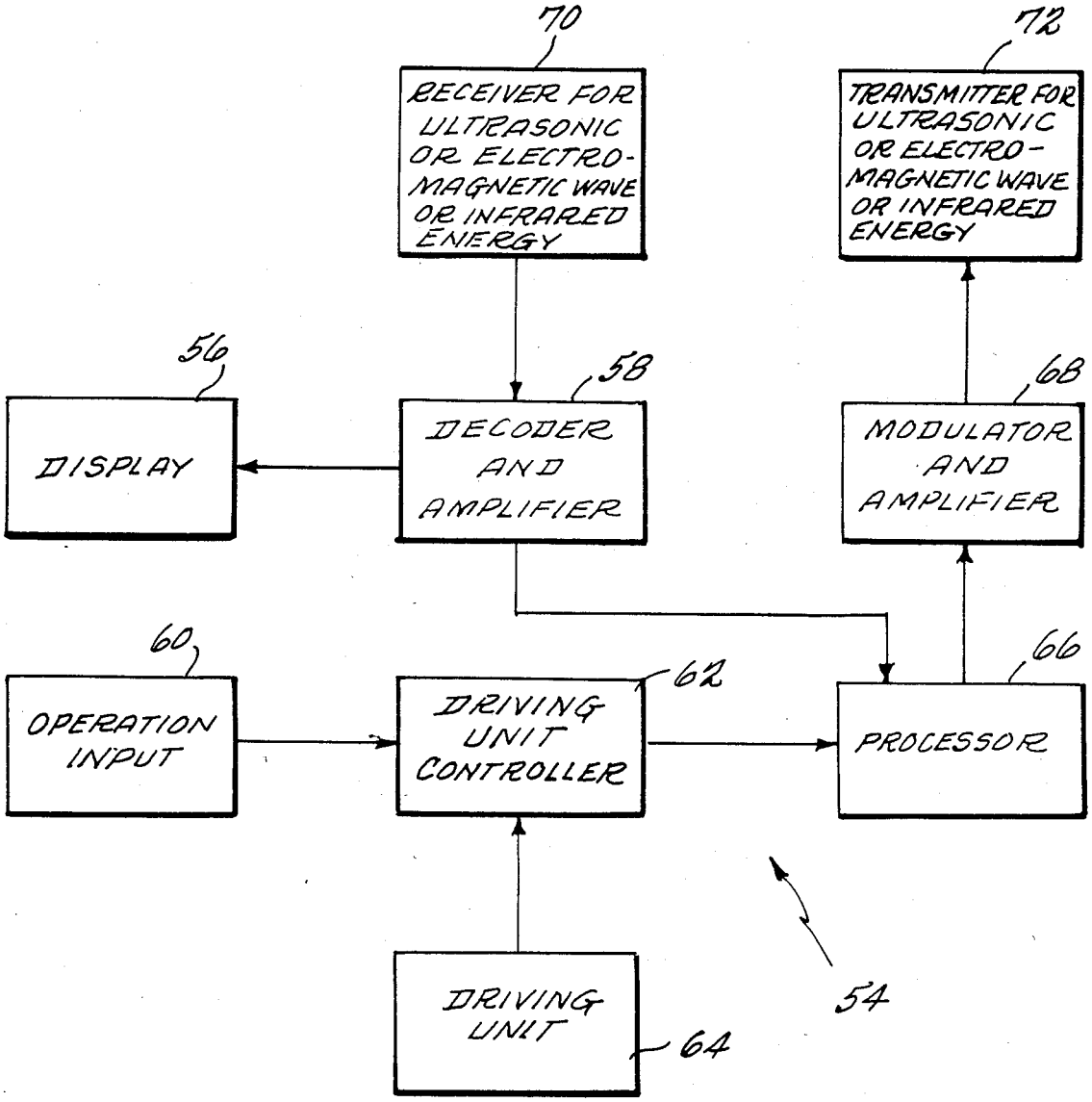
FIG. 4 is a block diagram of a presently preferred embodiment of the control and display system disposed on board the train in accordance with the present invention.

FIG. 4 shows a block diagram of a remote control and monitoring system 54 in accordance with the present invention. System 54 is placed on board train 10, and comprises a display 56, a decoder and amplifier 58, an input interface 60, a driving unit controller 62, a driving unit 64, a processor 66, a modulator and amplifier 68, a receiver 70 and a transmitter 72. The engineer of train 10 inputs remote control instructions to system 54 via input interface 60 (which may comprise any conventional data entry device, such as a keyboard, a bank of switches, etc.). The driving unit 64 of train 10 (which may include a conventional speed monitoring device such as an electronic speedometer) monitors the velocity of train 10. Driving unit controller 62 is responsive to the input signals produced by interface 60 and the velocity signal produced by driving unit 64, and applies a signal to processor 66. Processor 66 (which may comprise an analog computer, a known digital microprocessor or a microcomputer) processes the velocity signal and the input signals (using known processes) and applies a velocity control signal to modulator and amplifier 68, which modulates the signal transmitted by transmitter 72. In this way, the velocity of satellite car 12 may be controlled by input interface 60 together with the monitored velocity of train 10.

Figure 5:
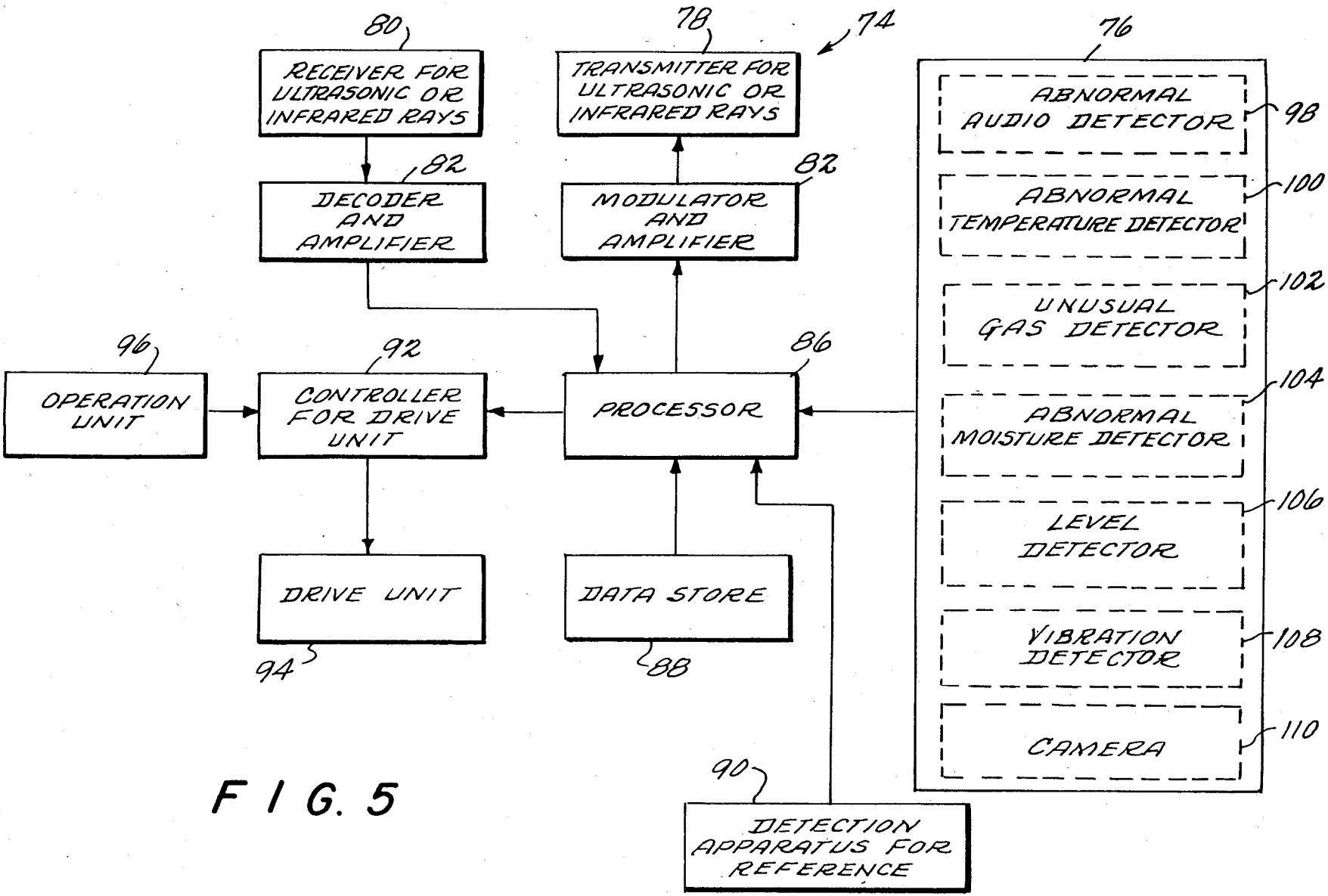
FIG. 5 is a block diagram of a presently preferred embodiment of the control and surveying module disposed on the satellite car in accordance with the present invention.

A block diagram of the presently preferred exemplary embodiment of a control and surveying module 74 in accordance with the present invention is shown in FIG. 5. Module 74 comprises a sensor array 76, a transmitter 78, a decoder and amplifier 82 , a modulator and amplifier 84, a conventional processor 86, a data storage unit 88, a detection apparatus 90, a drive equipment controller 92, a drive unit 94 and an operation unit 96. Receiver 80 receives the signal transmitted by transmitter 72 on board train 10. Decoder and amplifier 82 decodes the control information from the transmitted signal and applies the decoded control signal to processor 86. Processor 86 may read information out of data storage unit 88 (which may comprise a semiconductor memory device), and produces a control signal for driving the self-propulsion drive unit 94 of satellite car 12. Operation unit 96 may preset additional parameters for controlling drive unit 94.

Sensing array 76 produces information indicating the condition of the rails in proximity with satellite car 12. Sensing array 76 may comprise a plurality of sensors including an abnormal audio detector 98, an abnormal temperature detector 100, an unusual gas detector 102, an abnormal moisture detector 104, a level detector 106, a vibration detector 108 and a video camera 110. Sensor array 76 produces signals which are applied (after appropriate conventional A/D conversion if necessary) to processor 86. Processor 86 may further process the detected signals, may compare the detected signals with information stored in data storage unit 88, and then may apply the processed detected signals to modulator and amplifier 84. Modulator and amplifier 84 modulates the signal transmitted by transmitter 78. The modulated signal transmitted by transmitter 78 is received by receiver 70 on board train 10 (see FIG. 4). The received signal may be applied to display 56 (which may comprise a conventional CRT display, indicator lamps, audible warning transducers, etc.). By monitoring display 56, the engineer of train 10 may determine the conditions which he or she can expect to encounter ahead on tracks 14. Decoder and amplifier 58 may also apply a signal to processor 66 to enable it to further control the operation of module 74 disposed on satellite car 12 based upon signals received from the satellite car.

Abnormal audio detector 98 may be a conventional detector for detecting the level of sound. Audio detector 98 may be positioned on the body or the axle of satellite car 12. Audio detector 98 may comprise a micro-audiometer and level comparing circuit. Audio detector 98 applies a warning signal to processor 86 whenever the measured audio level is above a predetermined level. FIG. 8 is a schematic diagram of a conventional audio detector 98 including a microphone 112, an operational amplifier 114, a gain control 116 and a reference level adjustment control 118. Audio detector 98 may incorporate known selective devices (such as bandpass filters) so that it is sensitive to only a range of frequencies of sound.

Temperature detector 100 may comprise a conventional thermo-electric detector and a signal comparator. When the temperature detected by the thermo-electric detector is above or below a predetermined range, the signal comparator applies a warning signal to processor 86.

Unusual gas detector 102 may comprise a plurality of different, conventional gas sensors each of which sense the presence (above a predetermined level) of a different noxious gas. Gases to be sensed include carbon monoxide, methane, etc. When satellite car 12 passes through a tunnel or through mineral caves filled with noxious gases, gas detector 102 applies a warning signal to processor 86.

Moisture detector 104 comprises an electrode disposed at the bottom of the body of satellite car 12 a selected predetermined distance from the rail 14. When satellite car 12 travels through a flooded section of the railway and the level of the water is high enough to be dangerous to train 10, moisture detector 104 will contact the water and apply a corresponding warning signal to processor 86. Moisture detector 104 may operate using the difference in electrical conductivity between water and air, or may comprise any other conventional moisture detector.

Level detector 106 detects the orientation of satellite car 12 with respect to the direction of the force of gravity of the earth. Level detector 106 is shown in FIGS. 9–12, and comprises a container 120 approximately half filled with liquid mercury 122. A pair of electrodes 124 and 126 are disposed in container 120. Electrodes 124 and 126 each contact mercury 122 when container 120 is level with respect to the direction of the force of gravity (i.e. when the surface of mercury 122 is perpendicular to the direction of the force of gravity). If container 120 is tilted beyond a predetermined degree with respect to the direction of the force of gravity of the earth (such as would happen when satellite car 12 travels up or down a steep incline), one of electrodes 124 and 126 will no longer contact mercury 122, resulting in the loss of electrical conductance between the two electrodes (see FIGS. 10 and 11). Likewise, if satellite car 12 is suddenly stopped or slowed, mercury 122 in container 120 will be pushed by the force of inertia toward the front wall 128 of the container 120, also resulting in an open circuit between electrodes 124 and 126. If satellite car 12 is derailed and flips over or comes to rest at a non-horizontal angle, the electrical contact between electrodes 124 and 126 will also be interrupted. FIG. 12, for instance, shows the interruption of contact between electrodes 124 and 126 caused when satellite car 12 is flipped over (electrodes 124 and 126 do not make electrical contact in such an orientation because, in accordance with the present invention, they are insulated over at least a portion of their length by insulative material 130, which may be a portion of container 120). Whenever electrical contact between electrodes 124 and 126 is interrupted, a warning signal is applied to processer 86.

Camera 110 may comprise a conventional fast-scan or slow-scan video camera which produces video information. Camera 110 may include conventional servo motors or other devices (not shown) to enable the engineer of train 10 to change the direction in which the camera is aimed or the magnification of the camera lens (the camera control information is communicated the same way that drive control information is communicated).

Figure 17:
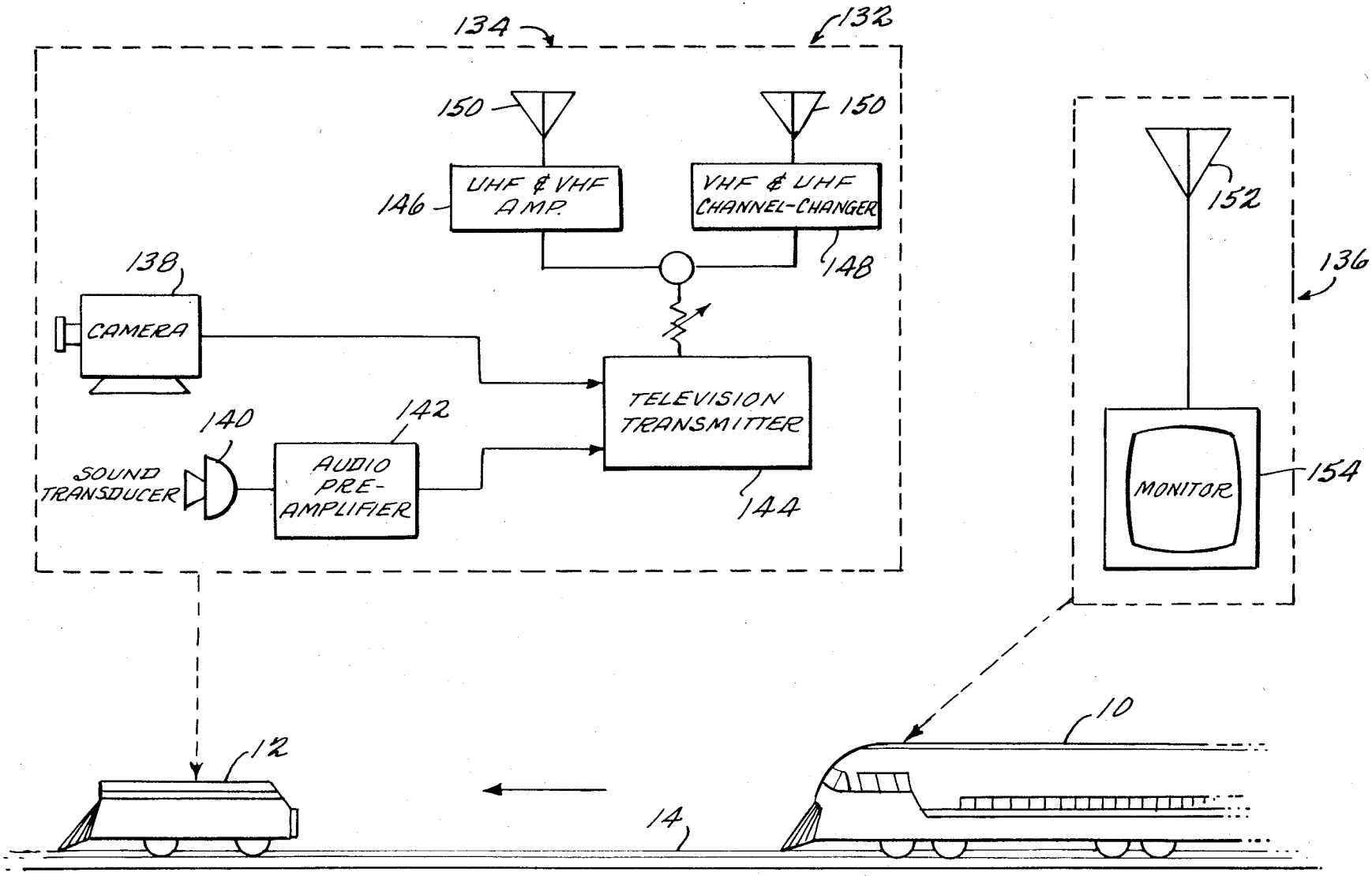
FIG. 17 is a functional block diagram of a video surveying system in accordance with the present invention.

FIG. 17 shows a block diagram of the video surveillance system in accordance with the present invention, which may be either included in the embodiment shown in FIGS. 4 and 5 or substituted therefore. Video surveillance system 132 comprises a video transmitter 134 on board satellite car 12 and a video monitor 136 on board train 10. Video transmitter 134 comprises a camera 138, a microphone 140, an audio preamplifier 142, a conventional television modulator 144, a UHF and VHF amplifier 146, a VHF-to-UHF channel changer 148, and one or more TV antennas 150. Camera 138 conventionally transforms a light image into a video signal, while microphone 140 transforms sound into an electrical audio signal. Both the video signal and the audio signal modulate a transmission beam (via TV modulator 144), and are transmitted via antenna 150 to an antenna 152 mounted on train 10. Antenna 152 is connected to a conventional monitoring television 154 which demodulates the transmitted audio and video and displays the video (and emits the audio) to be monitored by an engineer on board the train. By monitoring the visual image of a section of tracks 14 well ahead of train 10, an engineer on board train 10 can know what to expect and may take appropriate action to prevent potentially dangerous situations from occurring.

Vibration detector 108 on board satellite car 12 in accordance with one embodiment of the present invention is used to monitor the amount of mechanical vibration of the satellite car as it travels along tracks 14. Vibration detector 108 may comprise any conventional vibration detecting device. A vibration detecting device in accordance with the present invention is shown in FIG. 18. A body 156 is suspended above a substantially flat plate (such as the body of satellite car 12) by one or more springs 158. Mounted about the periphery of body 156 are a plurality of sensors 160 each of which respond to changes in position of the body. For instance, sensors 160 may be electrical contacts which contact plate 159 when the position of body 156 is disturbed by vibration, or alternatively, may comprise any other conventional sensor which detects up and down movement (such as hall effect sensors, mercury switches, etc.). Sensors 160 are connected to a conventional signal processor 162 which applies an output to processor 86. Processor 86 is connected to data storage unit 88, which stores vibration levels previously measured for each section of the rails 14 over which satellite car 12 is expected to pass. In particular, data storage unit 88 stores previously measured vibration levels of bridges as well as conventional programs for analyzing acoustic response. Processor 86 compares the vibration levels measured by sensors 160 with expected vibration levels. Processor 86 may produce a warning signal to be transmitted whenever the measured vibration levels exceed the expected vibration levels by a predetermined amount.

Figure 6:
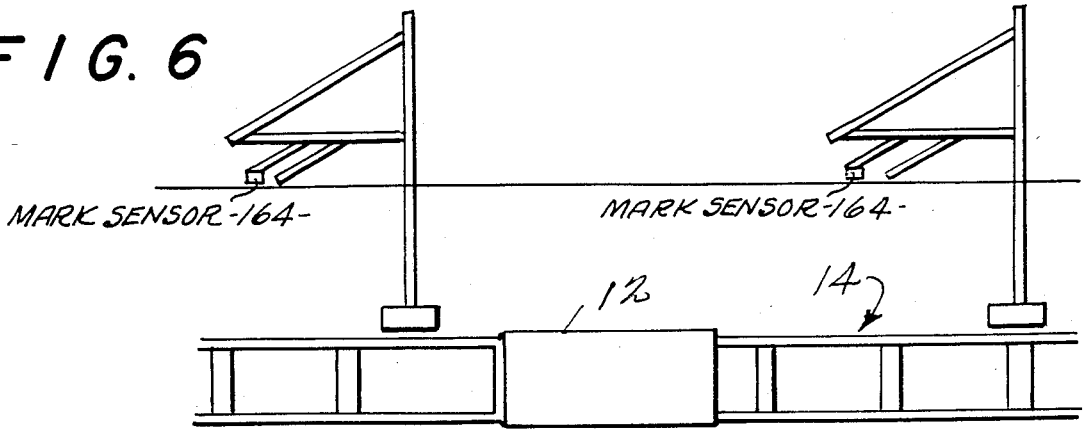
FIG. 6 is a view in plan of the placement of position indicating devices at stationary positions along th rails in accordance with the present invention.
Figure 7:
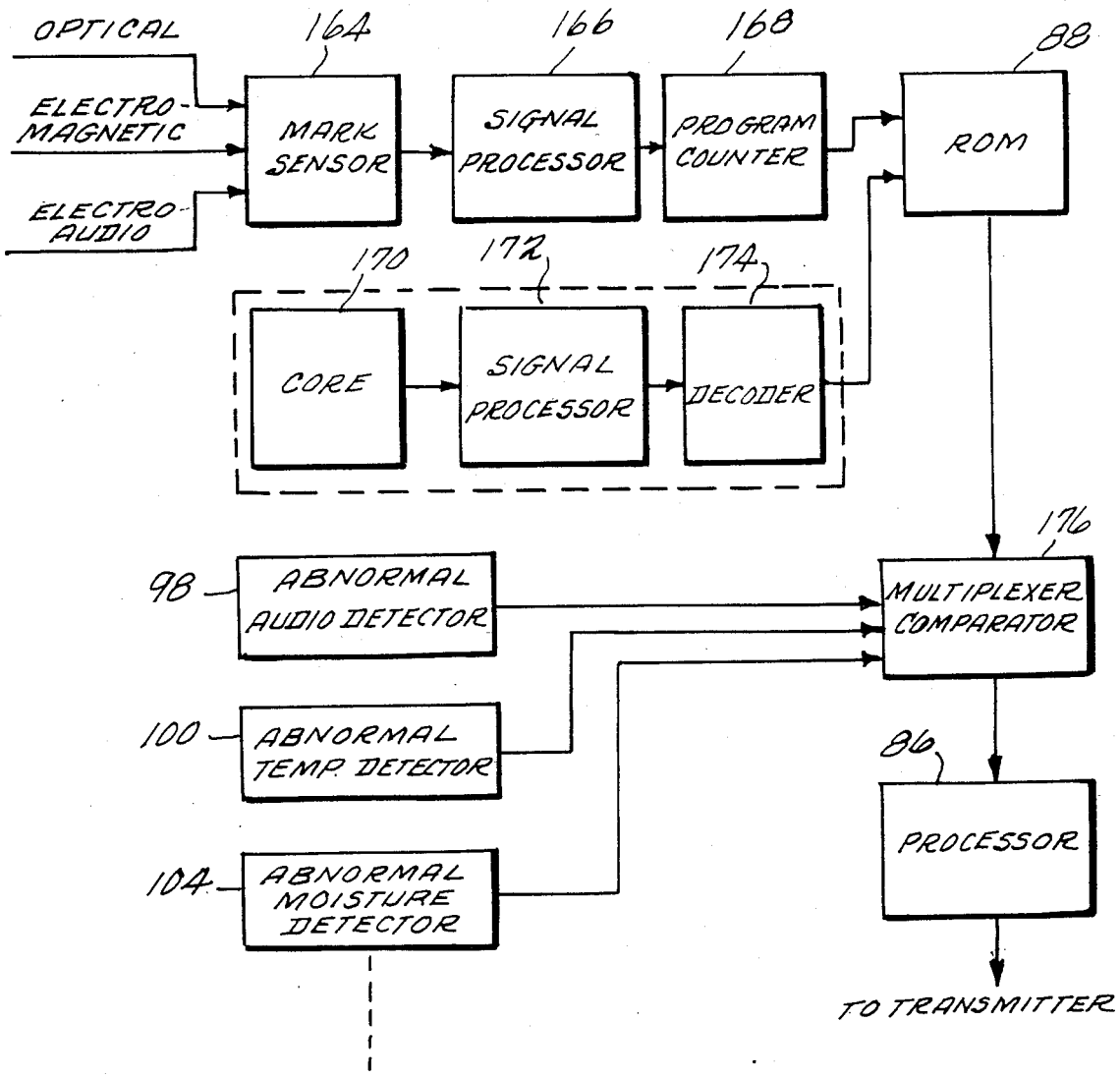
FIG. 7 is a detailed block diagram of another embodiment of the surveying module disposed on the satellite car in accordance with the present invention which utilizes information transmitted by the position indicating devices shown in FIG. 6.
Figure 13:
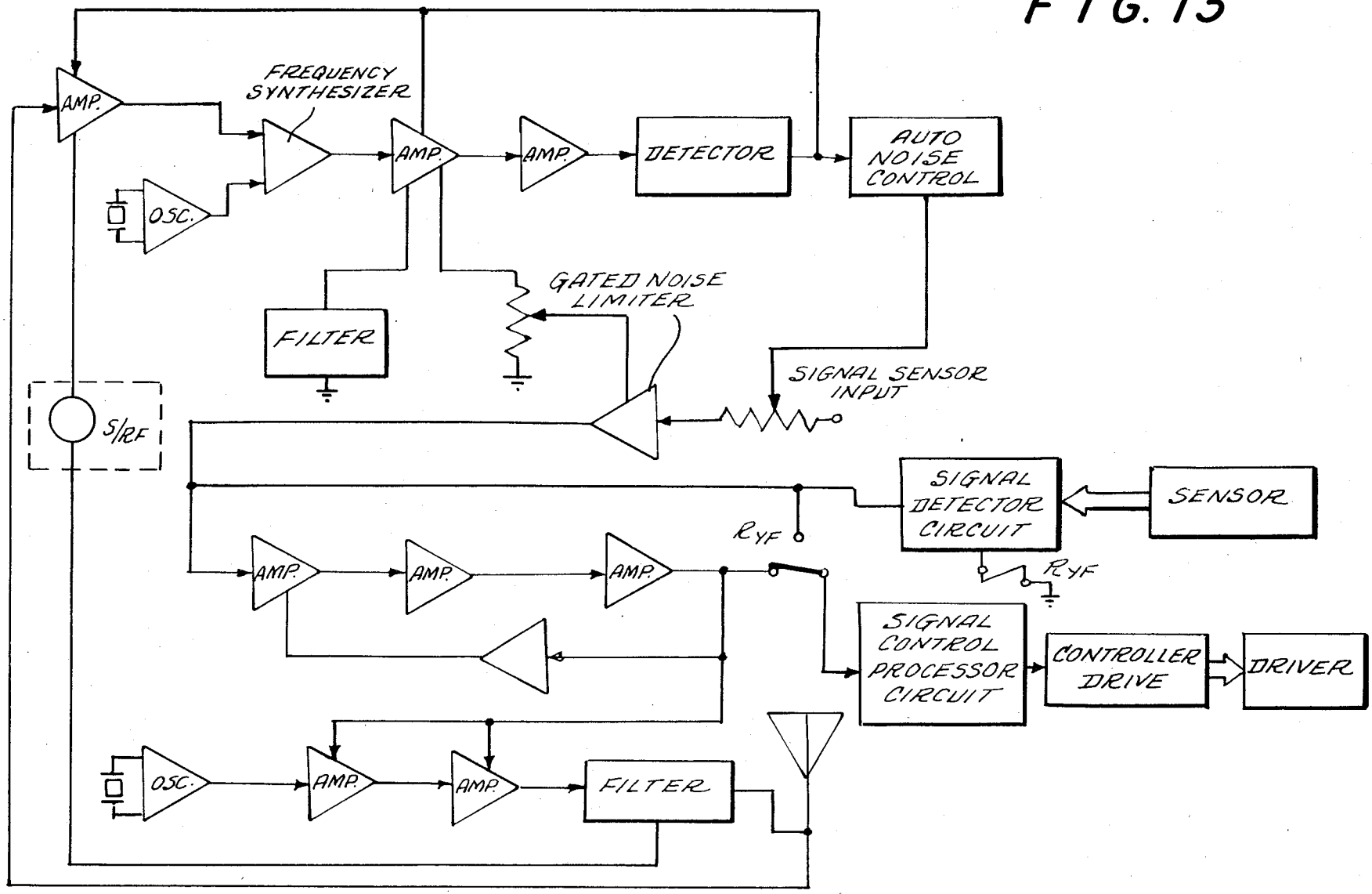
FIG. 13 is a schematic diagram of the presently preferred embodiment of the control and surveying module shown in FIG. 5.
Figure 14:
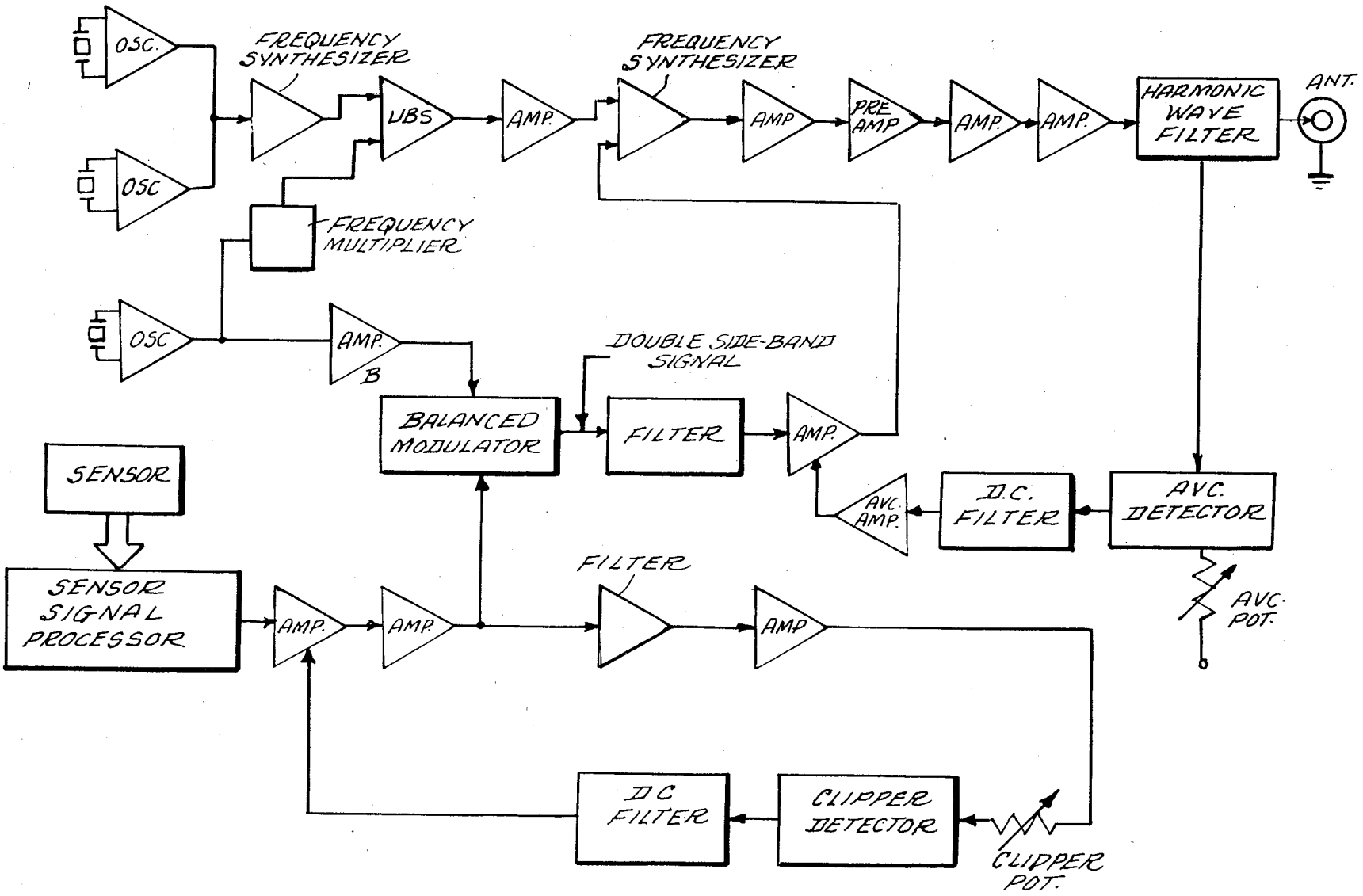
FIG. 14 is a schematic diagram of another presently preferred embodiment of blocks 84 and 78 of the control and surveying module shown in FIG. 5.
Figure 15:
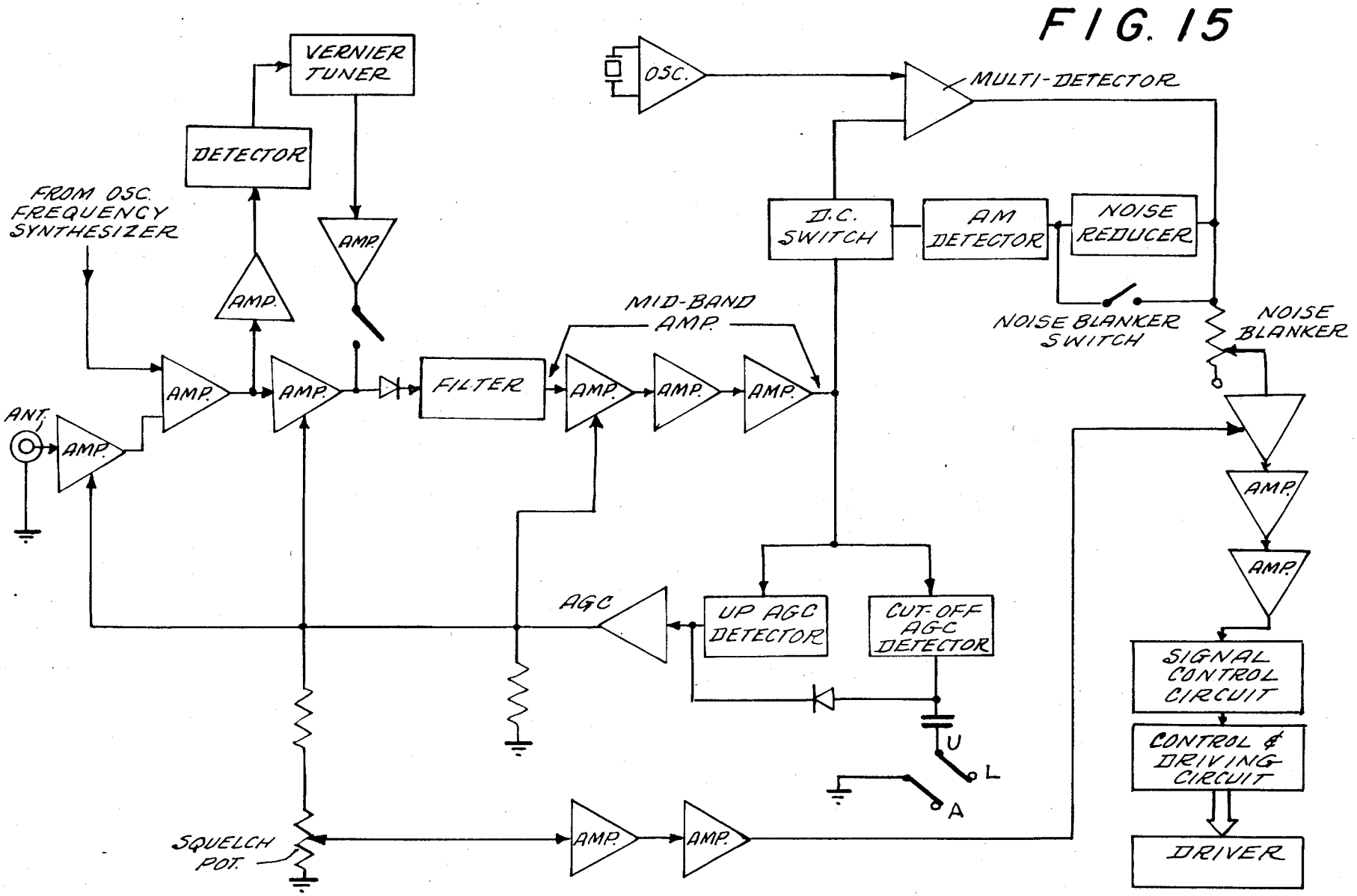
FIG. 15 is a schematic diagram of another presently preferred embodiment of blocks 80 and 82 of the control and surveying module shown in FIG. 5.
Figure 16:
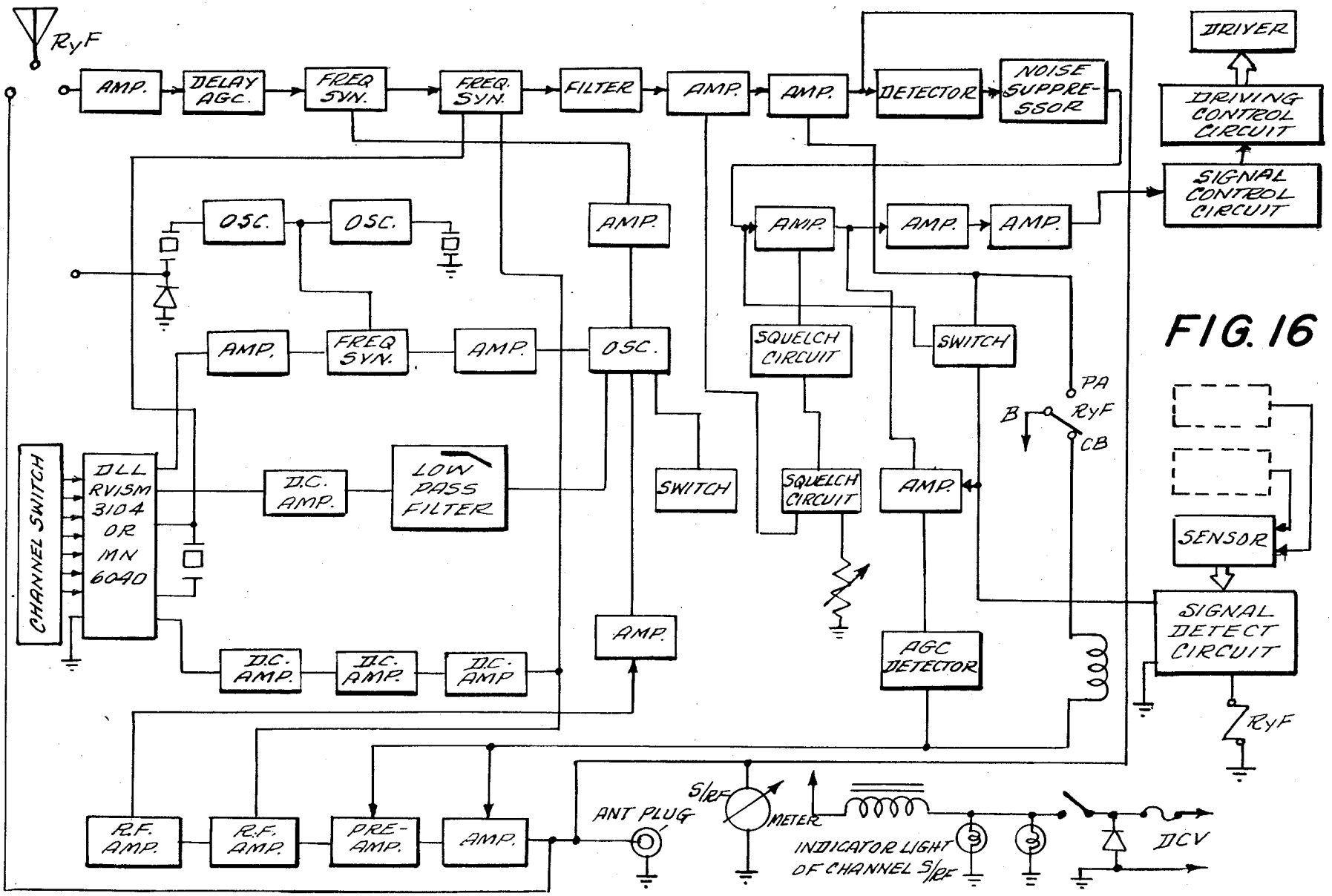
FIG. 16 is a schematic diagram of another presently preferred embodiment of the control and surveying module shown in FIG. 5.

As mentioned above, data storage unit 88 may store an expected vibration level for a plurality of different sections of tracks 14. Satellite 12 may independently determine its own position on tracks 12 by calculating the distance which it has moved from a known starting position. To increase the flexibility and accuracy of this position determining process, position indicating devices (as are shown in FIG. 6) placed at predetermined stationary points along tracks 14 may transmit position information to satellite car 12. Mark sensors 164 may comprise an optical, electromagnetic, electro-audio or electromechanical type switch which produces and transmits a coded signal indicative of its position along tracks 14 to satellite car 12. Alternatively, control and surveying module 74 may include a counter 168 (as is shown in FIG. 7) which simply increments each time satellite car 12 passes one of mark sensors 164. Counter 168 could be used to access a read only memory (ROM)

88 containing a variety of different information such as vibration level, orientation of satellite car 12 with respect to the direction of the force of gravity, etc. Processor 86 may compare measured parameters with stored parameters. If the measured and stored parameters do not correspond, a warning signal may be transmitted to train 10.

Vibration detector 108 may produce a continuous signal indicative of the vibrations on board satellite car 12 rather than a simple on/off warning signal indicating that the detected vibrations are above a predetermined level. This continuous signal indicative of vibration level may be transmitted to train 10 and received by processor 66. As FIG. 19 shows, a signal processor 178 may further process the received vibration level signal. The vibration level signal may be applied to a bank of control valves 180. Control valves 180 are coupled to a source 182 of pressured fluid (such as liquid or air) and selectively route the fluid to a plurality of cylinders 184. Cylinders 184 are positioned about the periphery of a bottom 186 of a chair 188. Chair 188 is adapted to receive a seated human being. Control valves 180 are controlled in a manner such that the movement of chair 188 corresponds to the vibration level sensed on and transmitted by satellite car 12. Cylinders 184 may comprise conventional liquid pressure or pneumatic pressure linear driving devices, or alternatively, may comprise electromagnetic actuators. In this way, a human being can sense the vibration level present on satellite car 12. Alternatively, a human being can be isolated from vibration by causing cylinders 184 to react (after a time delay determined by the absolute and relative velocities of train 10 and satellite car 12) in an opposite direction to that of the sensed vibration. Additionally, if the vibration level exceeds a predetermined level, an audible warning indicator may sound.

FIGS. 13–16 are schematic diagrams of embodiments in accordance with the present invention for radio frequency transmitting and receiving devices which can be used with the present invention to transmit information between the train 10 and satellite car 12.

Satellite car 12 may be equipped with automatically locking suspension couplings for locking the satellite car to train 10. When satellite car 12 ceases to function (or in the event of an emergency), train 10 as well as satellite car 12 may be hauled away by another train locomotive using such locked couplings.

Although only a few exemplary embodiments have been described in detail above, those skilled in the art will appreciate that many variations and modification may be made in these exemplary embodiments without departing from the novel and advantageous features of this invention. Accordingly all such variations and modifications are intended to be included within the scope of the following claims.

What is claimed:

1. A system for surveying railway tracks disposed a distance away from a train adapted for travelling rectilinearly along said tracks, said system including:

a satellite car also adapted for travelling rectilinearly along said tracks, said satellite car including:

drive means for propelling said satellite car along said tracks;

control means, adapted to receive control signals transmitted by said train and operatively connected to said drive means, for maintaining said satellite car a predetermined distance from said train;

audio detecting means for detecting the level of sound energy produced by the travel of said satellite car over said tracks; and first transmitting means for transmitting information to said train, said information comprising at least said detected sound energy level to said train;

second transmitting means, disposed on said train, for transmitting said control signals to said control means;

receiving means disposed on said train for receiving said information transmitted by said first transmitting means; and display means disposed on said train for displaying said received information.

2. A system as in claim 1 wherein said satellite car further includes:

storing means for storing a predetermined level of sound energy corresponding to at least one predetermined section of said tracks; and means for producing a warning signal whenever said stored sound energy level exceeds said level measured by said audio detecting means by a predetermined amount, said first transmitting means being responsive to said warning signal.

3. A system as in claim 2 wherein:

said railway tracks include a plurality of position transmitting means, each disposed at a stationary position on said tracks, for transmitting coded indicia of said stationary position to said satellite car;

said storing means stores predetermined sound energy levels corresponding to a plurality of predetermined sections of said tracks; and said satellite car further includes:

position receiving means for receiving said transmitted coded indicia; and means for accessing from said storing means the stored sound energy level corresponding to the position on said tracks of said stationary position indicated by said received coded indicia.

4. A system as in claim 1 wherein said satellite car further includes temperature detecting means for detecting the temperature in proximity with said satellite car, said first transmitting means responsive to said detected temperature.

5. A system as in claim 1 wherein said satellite further includes gas detecting means for detecting the presence of at least one of a plurality of gases in proximity with said satellite car, said first transmitting means responsive to said detected presence.

6. A system as in claim 1 wherein said satellite car further includes moisture detecting means, disposed on said satellite car a predetermined height above said tracks, for detecting the presence of water at said predetermined height, said first transmitting means responsive to said detected presence.

7. A system as in claim 1 wherein said satellite car further includes orientation monitoring means for monitoring the orientation of said satellite car with respect to the direction of the force of gravity of the earth, said first transmitting means responsive to said monitored orientation.

8. A system as in claim 1 wherein said satellite car further includes television camera means for monitoring the visual scene presented to said satellite car as it travels along said tracks, said first transmitting means responsive to said monitored scene.

9. A system as in claim 1 wherein said satellite car further includes vibration detecting means for detecting the level of mechanical vibration present on said satellite car as said satellite car travels along said tracks, said first transmitting means responsive to said detected level.

10. A system as in claim 9 wherein said system further includes a chair, disposed on said train and adapted to receive a seated human being, said chair including means responsive to said information received by said receiving means for vibrating said chair according to the level of mechanical vibration detected by said vibration detecting means.

11. A system for surveying railway tracks disposed a distance away from a train, said train adapted for travelling rectilinearly along said tracks, said system including:

a satellite car adapted for travelling rectilinearly along said tracks, said satellite car including:

drive means for propelling said satellite car along said tracks;

control means, adapted to receive control signals transmitted by said train and operatively connected to said drive means, for maintaining said satellite car a predetermined distance from said train;

first transmitting means for transmitting information to said train;

temperature detecting means for detecting the temperature in proximity with said satellite car, said first transmitting means responsive to said detected temperature;

gas detecting means for detecting the presence of at least one of a plurality of gases in proximity with said satellite car, said first transmitting means responsive to said detected presence of said one;

moisture detecting means, disposed on said satellite car a predetermined height above said tracks, for detecting the presence of water at said predetermined height, said first transmitting means responsive to said detected presence;

orientation monitoring means for monitoring the orientation of said satellite car with respect to the direction of the force of gravity of the earth, said first transmitting means responsive to said monitored orientation;

television camera means for monitoring the visual scene presented to said satellite car as it travels along said tracks, said first transmitting means responsive to said monitored scene;

vibration detecting means for detecting the level of mechanical vibration present on said satellite car as said satellite car travels along said tracks, said first transmitting means responsive to said detected vibration level; and audio detecting means for detecting the level of sound energy produced by the travel of said satellite car over said tracks, said first transmitting means responsive to said detected sound energy level;

second transmitting means disposed on said train for transmitting said control signals to said control means;

receiving means disposed on said train for receiving said information transmitted by said first transmitting means; and display means disposed on said train for displaying said received information.

12. A system as in claim 1 wherein said satellite car further includes:

storing means for storing a predetermined level of sound energy corresponding to at least one predetermined section of said tracks; and means for producing a warning signal whenever said stored sound energy level exceeds said level measured by said audio detecting means by a predetermined amount, said first transmitting means being responsive to said warning signal.

13. A system as in claim 12 wherein:

said railway tracks include a plurality of position transmitting means, each disposed at a stationary position on said tracks, for transmitting coded indicia of said stationary position to said satellite car;

said storing means stores predetermined sound energy levels corresponding to a plurality of predetermined sections of said tracks; and said satellite car further includes:

position receiving means for receiving said transmitting coded indicia; and means for accessing from said storing means the stored sound energy level corresponding to the position on said tracks of said stationary position indicated by said received coded indicia.

14. A system as in claim 11 wherein said system further includes a chair disposed on said train and adapted to receive a seated human being, said chair including means responsive to said information received by said receiving means for vibrating said chair according to the level of mechanical vibration detected by said vibration detecting means.

* * * * *